US005099769A

United States Patent [19]

Petrie et al.

[11] Patent Number: 5,099,769

[45] Date of Patent: Mar. 31, 1992

[54] DOOR MECHANISM

[76] Inventors: A. Stephen Petrie, 31 Evelyn AVenue, Toronto, Ontario M6P 2Z2; Peter Deirish, 65 Halsey Avenue, East York, Ontario, M4B 1A7, both of Canada

[21] Appl. No.: 422,964

[22] Filed: Oct. 18, 1989 (Under 37 CFR 1.47)

[51] Int. Cl.[5] ..... F23K 3/16

[52] U.S. Cl. ..... 110/116; 110/418; 110/293

[58] Field of Search ..... 110/108, 116, 117, 293, 110/109

[56] References Cited

U.S. PATENT DOCUMENTS

| | | | |
|---|---|---|---|
| 794,853 | 7/1905 | Cox . | |
| 1,152,363 | 8/1915 | Weisberger . | |
| 2,394,811 | 2/1946 | Rymer | 126/190 |
| 2,454,400 | 11/1948 | Horman | 110/293 X |
| 4,126,119 | 11/1978 | Fike | 126/124 |
| 4,185,567 | 1/1980 | Grossniklaus | 110/101 |
| 4,339,998 | 7/1982 | Finch | 110/186 |
| 4,421,040 | 12/1983 | Lindstrom | 110/116 X |
| 4,442,825 | 4/1984 | Waldau | 126/68 |
| 4,444,538 | 4/1984 | Manley | 414/176 |
| 4,530,289 | 7/1985 | Godbout | 110/117 |
| 4,606,282 | 8/1986 | Steindal | 110/116 |
| 4,865,016 | 12/1989 | Landry | 110/108 X |

*Primary Examiner*—Edward G. Favors

*Attorney, Agent, or Firm*—Willian Brinks Olds Hofer Gilson & Lione

[57] ABSTRACT

A door mechanism for supplying solid fuel to a store of a solid fuel burning appliance has a body defining a transfer chamber having an inlet and an outlet. An inner door is movably mounted to the body for closing the outlet thereof, the inner door normally closing off the outlet but being displaceable by solid fuel to an open position, for example against the influence of gravity. An outer door is mounted for closing off the inlet, and again is movable between a closed position and an open position. A displacement member is secured to the outer door. The displacement member is dimensioned so as to displace fuel from the transfer chamber through the outlet, as the outer door is closed.

23 Claims, 8 Drawing Sheets

DOOR MECHANISM

FIELD OF THE INVENTION

This invention relates to a door mechanism for feeding fuel into a store or magazine of a solid fuel appliance, more particularly a wood-burning furnace. This invention is generally applicable to the feeding of solid material into a zone that should be isolated from the exterior, for example a zone of high temperature and having noxious gases under pressure.

BACKGROUND OF THE INVENTION

At the present time, there are a variety of furnaces and heating systems available for heating buildings, particularly houses or single family dwellings.

Commonly, in most developed countries, fossil fuel is used, eg. oil, gas, coal or coke. The latter two fuels have become less common for domestic use, due to handling problems. It is difficult and expensive to provide any sort of automatic handling and feeding arrangement for such solid fuels. Oil and gas on the other hand have the advantage that, being fluids, it is a relatively simple matter to regulate their flow to a furnace or water heater. As a consequence, furnaces and water heaters and other heating appliances fueled by oil and gas can be run automatically and left unattended for long periods. Oil and gas can both be stored in relatively large quantities and a combustion chamber configuration for automatic operation can readily be designed.

At the present time, the use of wood as a fuel is regaining popularity in various parts of North America and elsewhere. In many developing countries, and underdeveloped countries, wood is a significant energy source. In appropriate areas, it has the advantage that it is readily available and relatively inexpensive. Typically, in a house or single unit dwelling, the wood is burnt in a fireplace, which may be open or closed, or in a freestanding wood stove or in a furnace or boiler. Water heating units can be incorporated, as desired. Wood, however, like coal and coke, suffers from the disadvantage of being a solid fuel. This makes it necessary to manually fuel a heating unit at regular intervals. Also, wood has a relatively low heat value per unit volume, necessitating relatively frequent fueling of the stove or furnace.

One difficulty with a wood burning appliance is to operate it efficiently for a long period of time. For a conventional wood burning appliance, if it is operated efficiently, it will consume a charge of wood in a relatively short time and give excessive power output. The combustion time can be extended, by reducing the combustion rate, e.g. by restricting the air supply. However, this results in inefficient combustion. This in turn can result in uncombusted material being deposited in the flue, which can cause a fire, or being vented to the atmosphere as pollutants.

One solution to this problem is to provided a fuel store which is separate from the combustion chamber, but is still an integral part of the whole appliance. As discussed below, there are numerous earlier patents suggesting such a possibility. Some door designs provide a movable baffle suspended across the top of the door, which is displaced by solid fuel passing through. The difficulty with a fuel store is to both ensure that feeding of fuel to the combustion is simple and reliable, and also that the fuel store can be simply and easily recharged.

The fuel store can be provided to one side of the combustion chamber, and this diminishes the likelihood of the escape of noxious gases, while also reducing the possibility of combustion extending into the fuel store.

For simplicity of feeding fuel to the combustion chamber, the fuel store should be provided directly above the combustion chamber. However, one then has the problem of preventing combustion from extending into the fuel store and also the problem of preventing the escape of hot, noxious fumes to the exterior.

Most contemporary doors are quite simple, and when opened to admit fuel into the fuel store, give a direct passage between the exterior and the fuel store. For many configurations, in operation, the fuel store is full of hot, noxious gases under pressure. Consequently, when the door is opened, these gases, smoke etc. are vented to atmosphere. The problem can be reduced by placing a door lower down, but ideally one needs to charge a fuel store from the top.

It is to be appreciated that, as well as separate fuel stores, this difficulty with a door mechanism is present in conventional solid fuel appliances. Thus, most conventional door designs do not tackle the problem of preventing or reducing the escape of smoke and hot noxious fumes when the door is open to recharge the furnace.

The prior art teaches a number of door mechanisms for feeding fuel into a magazine of a solid fuel appliance. By way of example, U.S. Pat. No. 794,853 (Cox) shows an inclined fuel chute with a series of division doors in it, which can be operated independently, to supply batches of fuel. However, these doors are not intended to provide a lock effect for feeding of a fresh supply at regular intervals.

U.S. Pat. No. 1,152,363 (Weisberger), like many other patents, discloses just a single door for feeding fuel.

U.S. Pat. No. 2,394,811 (Rymer), discloses a door mechanism intended to eliminate substantially the escape of smoke and fumes from a combustion chamber. A stove is provided with an outer door and an inner closure member. The closure member is pivoted in the upper part of the combustion chamber. Each of the side walls of the closure member is provided with a pivoted dog and the outer door is provided with lugs on either side. In the closed position, the lugs are positioned below the dogs. During an opening movement of the door, the dogs are free to swing in a counterclockwise direction about their pivot axes, thereby permitting free opening movement of the door without any corresponding movement of the closure member. When the door arrives at its open position, the lugs have moved to such an extent that they then engage the dogs. The space between the door and the closure member is charged with fuel. When the door is closed, the lugs push on the dogs and open the closure member. This enables the fuel to drop down into the interior of the stove. When the door reaches its fully closed position, the lugs disengage the dogs, permitting the closure member to return to the closed position, ready for the next charging of the stove. A disadvantage with the Rymer arrangement is that there is no positive displacement of the fuel from the space between the closure member and the door. Clearly, any fuel left here will become hot. Consequently, if the door is then opened, fumes and the like will be released. There may also be a fire hazard.

U.S. Pat. No. 4,126,119 (Fike) is an example of a disclosure of a heating device, in which a fuel supply is provided. Here, the mechanism for feeding logs is simply a door at the outer end of the device.

A somewhat complex feeding arrangement is disclosed in U.S. Pat. No. 4,185,567 (Grossnicklaus). This is of some interest in showing the complexity that can arise when a feed other than gravitational is employed. Here, Grossniklaus relies upon the arrangement of a ram and the fuel store beside the combustion chamber to keep the combustion gases out of the fuel store. Three separate flaps are provided for displacing the wood towards a ram, and the ram drives the wood through a feed duct into the combustion chamber.

U.S. Pat. No. 4,339,998 (Finch) relies upon gravity feed the end of a conveyor, and a counterweighted self-closing door is provided.

Similarly, U.S. Pat. No. 4,442,825 (Waldau) provides a feeding device which relies upon a gravity feed. It has doors at either end, but again no positive displacement of the fuel is provided.

An automatic log feeder is provided in U.S. Pat. No. 4,444,538 (Manley), but this again relies upon a simple gravity feed and a flap-type door at the entry to the fireplace.

U.S. Pat. No. 4,530,289 (Godbout) discloses a solid fuel furnace, in which a feeder is closed to the atmosphere, to prevent combustion extending into it. However, it does not include any mechanism enabling it to be charged in use, whilst preventing fumes escaping. U.S. Pat. No. 4,606,282 (Steindal) is similar in this respect. It provides for feeding of fuel to a combustion zone, while preventing the flow of air through the wood storage area. However, it again does not provide any interlock door mechanism to prevent the escape of fumes if it is charged in use.

SUMMARY OF THE PRESENT INVENTION

Accordingly, it is desirable to provide, for a solid fuel furnace or the like, a door mechanism, which provides an interlock to prevent the escape of fumes, and simulaneously is such as to ensure that fuel is positively displaced through it. Preferably, such a mechanism is incorporated as part of a fuel store or magazine for a solid fuel furnace.

In accordance with the present invention, there is provided a door mechanism for supplying solid fuel to a store of a furnace. The mechanism comprises a body defining a transfer chamber and having an inlet and an outlet. An inner door is movably connected to the body for closing the outlet, the inner door normally closing off the outlet but being displaceable by solid fuel to an open position. An outer door is connected to the body and movable between a closed position closing off the inlet and an open position. A displacement member is connected to the outer door for displacing solid fuel from the transfer chamber through the outlet, the displacement member occupying a significant portion of the transfer chamber when the outer door is in the closed position.

Preferably, the displacement member occupies substantially all the transfer chamber when the outer door is in the closed position. The inner door can be mounted about a horizontal axis above the outlet, so as to be closed by the influence of gravity. The outer door can be mounted about a vertical axis.

For feeding logs, the transfer chamber can have a width greater than its height. The logs can be inserted sideways while being held with both hands.

BRIEF DESCRIPTION OF THE DRAWINGS

In describing a preferred embodiment of the present invention, and to show more clearly how it may be carried into effect, reference will now be made to the accompanying drawings, in which.

DESCRIPTION OF THE PREFERRED EMBODIMENT

Figure 1:
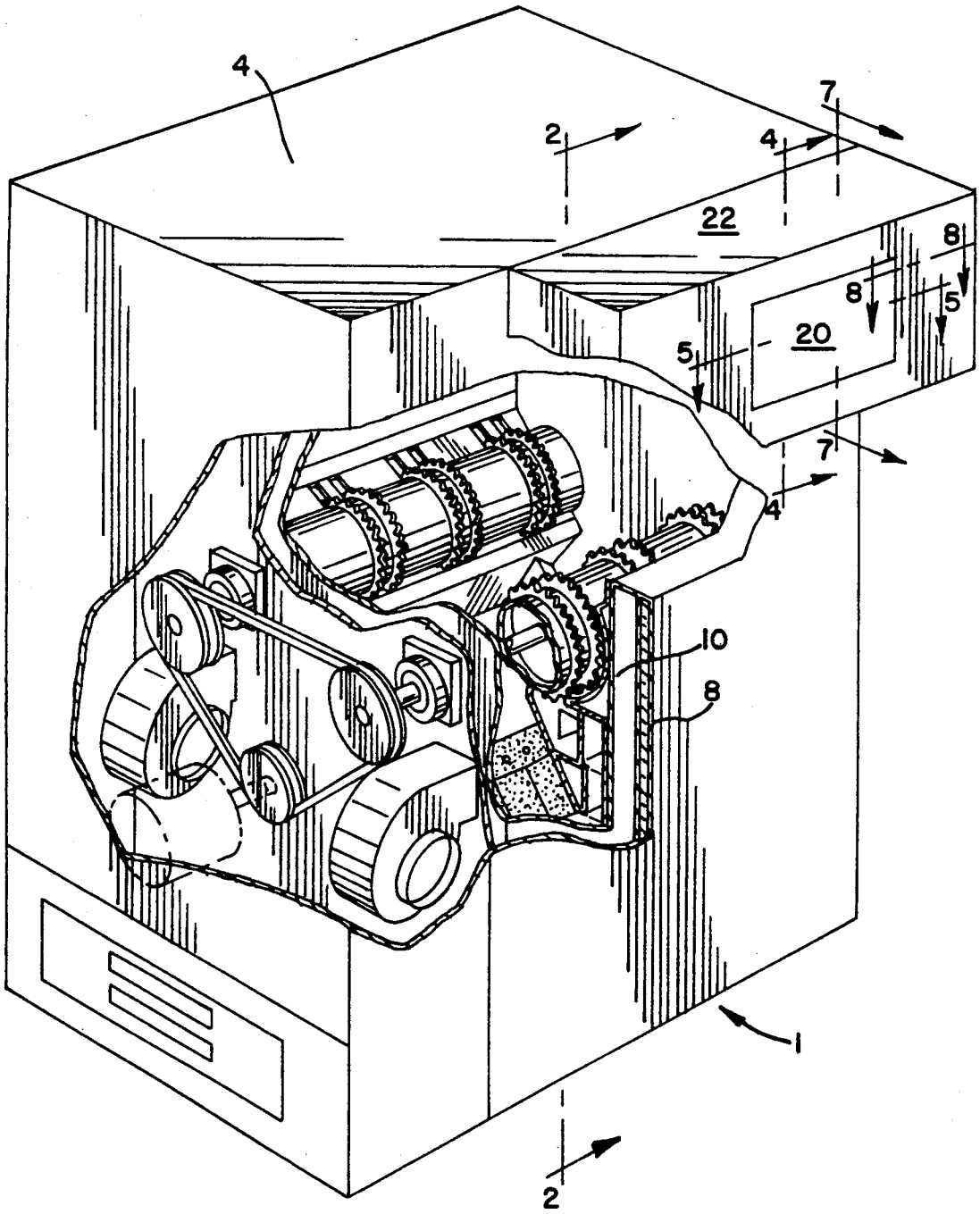
FIG. 1 is a partially cut away perspective view of a furnace incorporating the door mechanism of the present invention.
Figure 2:
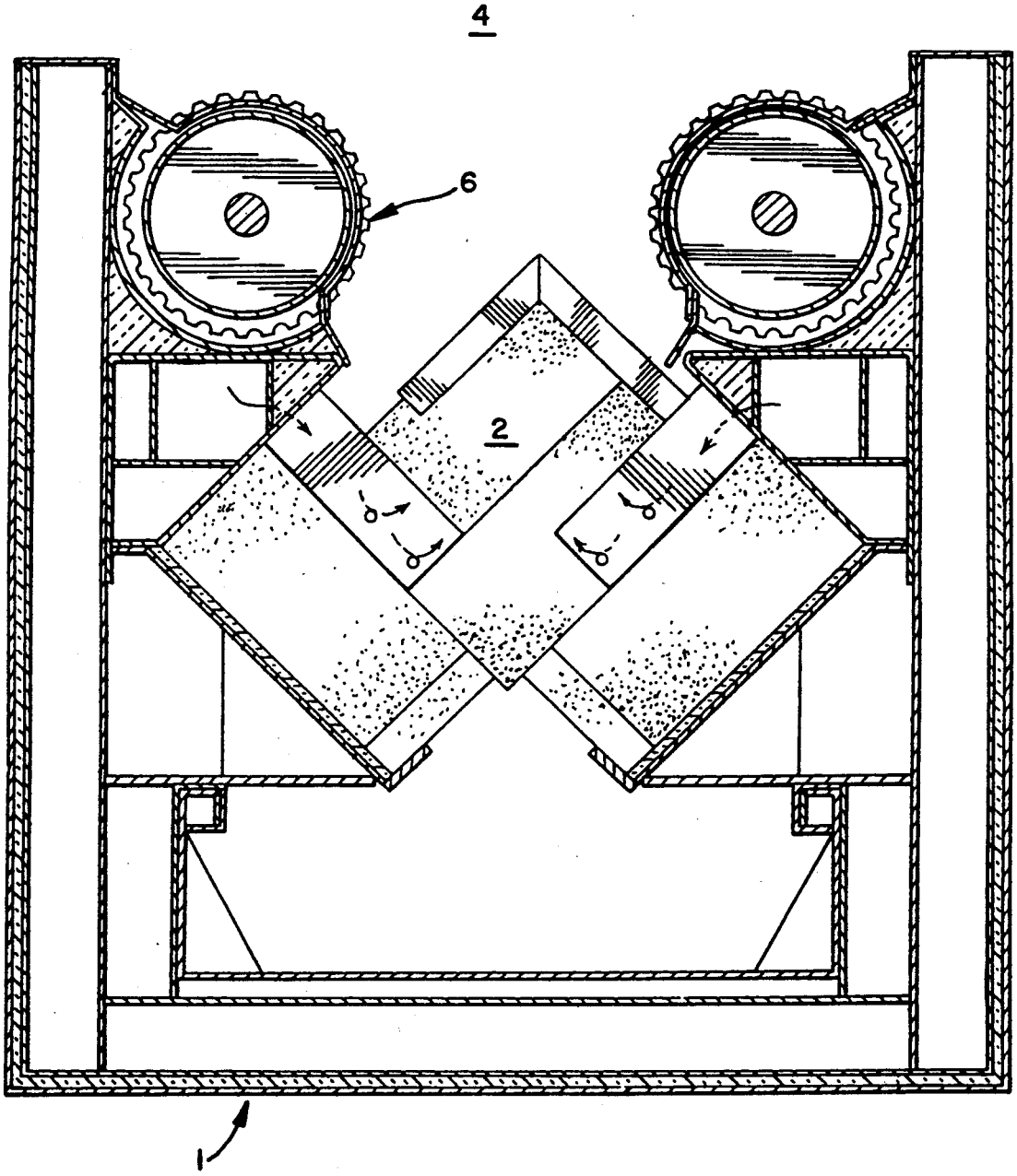
FIG. 2 is a vertical section through the combustion chamber of the furnace of FIG. 1 along lines 2—2 in FIG. 1.

FIG. 1 shows a furnace generally denoted by the reference 1. The furnace 1 includes a combustion chamber 2, (FIG. 2) and above the combustion chamber 2 a log magazine or store 4. A roller mechanism 6 (FIG. 2) is provided between the combustion chamber and log magazine. The roller mechanism 6 is the subject of my copending and concurrently filed patent application Ser. No. 07/423,342.

The walls of the combustion chamber are insulated, as indicated at 8 and are hollow as indicated at 10.

In accordance with the present invention, there is provided a door mechanism 20 for feeding logs into the log magazine. The door mechanism is provided as an extension part 22 protruding out to one side of the main log magazine. Behind the log magazine, there may be a heat exchanger, for deriving heat from the exhaust gases from the combustion chamber.

Figure 4:
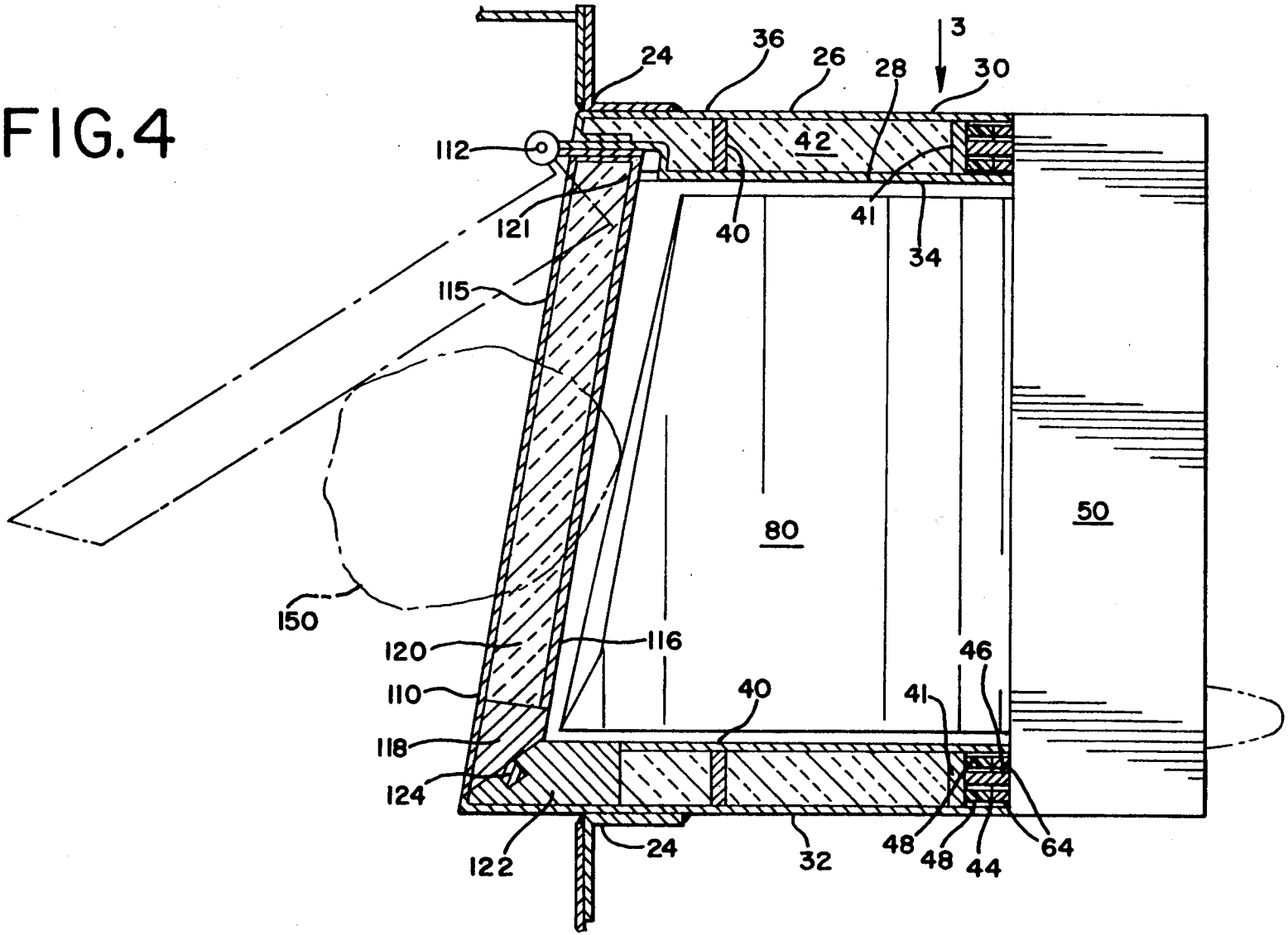
FIG. 4 is a vertical section through the door mechanism along lines 4—4 in FIG. 1.

Referring to FIG. 4, the door mechanism 20 is mounted to the log magazine or store by means of angle section member 24, which are appropriately welded. The door mechanism has a body 26, which defines a transfer chamber 28. The body has top 30 and bottom 32 walls. The body also has side walls which are not visible in FIG. 4.

Each of the walls has a generally similar construction. Thus, each of the top and bottom walls includes an inner plate 34 and an outer plate 36, both formed of steel. Bridging pieces 40, 41 secure the inner and outer plates together. Insulation 42 fills the space between the plates.

For an outer door 50, which is detailed below, an outer seal generally shown at 44 is provided around the periphery of the body. A dividing member 46 divides the space between the inner and outer plates into two slots. The corners between the side, bottom and top walls are rounded, so that these two slots are continuous around the outer edge of the body. The rounded corners are preferred but not essential. Resilient gaskets 48 of suitable material, are provided in these two slots.

The outer door is hinged about a vertical axis 52 (FIG. 3), and for this purpose the body includes a pair of hinge plates 54, extending out from one side wall of the body and vertically spaced. Correspondingly, the outer door includes a pair of hinge plates 56, each of which rests on top of a respective plate. Appropriate pivots are provided at the pivot axis 52.

Figure 5:
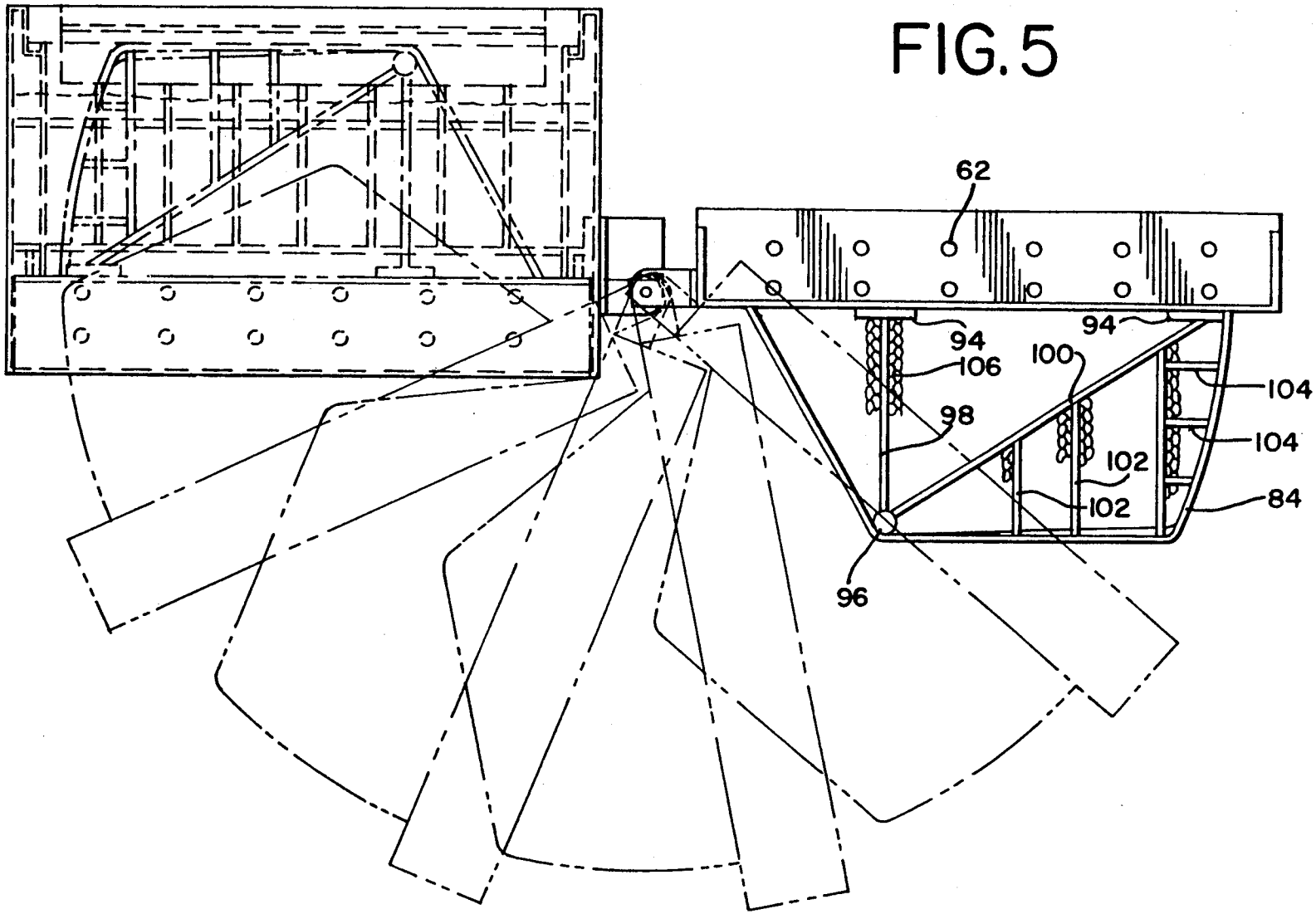
FIG. 5 is a horizontal section through the door mechanism along lines 5—5 in FIG. 1.
Figure 6:
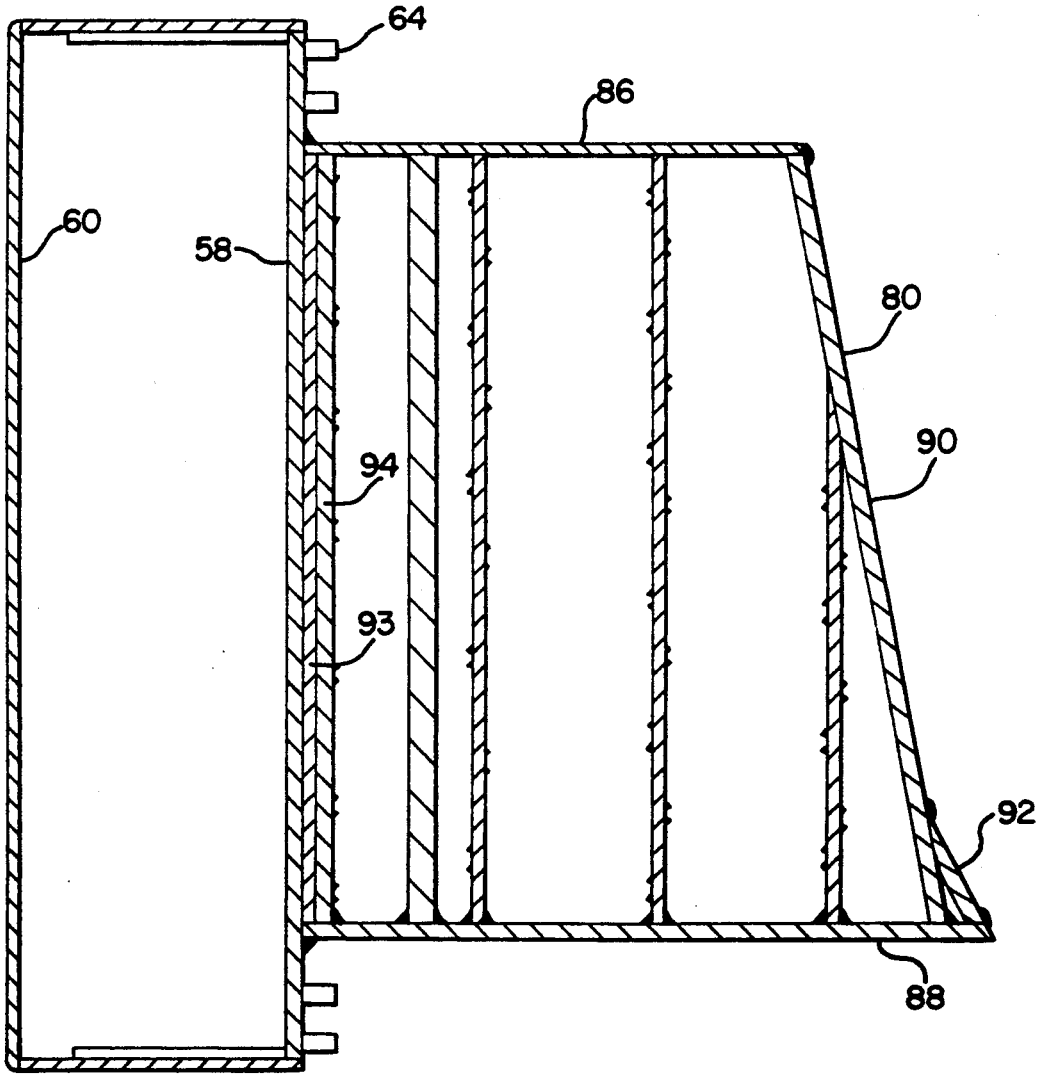
FIG. 6 is a vertical section through the outer door of the door mechanism along lines 6—6 in FIG. 3.

With reference to FIG. 6, the outer door 50 is a hollow shell structure comprising an inner shell 58 and an outer shell 60. The shells 58, 60 overlap one another at the sides, top and bottom, and may be held together by screws, as indicated at 62 (FIG. 5). The shells may be strengthened with appropriate ribs, dish head stiffeners and the like, as necessary. The interior of the outer door 50 is filled with insulation material.

Around the inner shell 58, and directed inwards, are two continuous projections 64, which are welded to the inner shell. The projections are configured to enter the slots on either side of the dividing member 44 (FIG. 4) and abut the gaskets 48 to form a seal.

To close the door, a handle 66 (FIG. 3) is provided. The handle has a catch, which engages a corresponding part of the body. The handle includes a knob 68 to release the catch. If desired, the handle may be provided with a lock, for security purposes, so as to prevent children etc. tampering with it.

Attached to the door 50 is a pusher or displacement member 80, which, as detailed below, is intended to displace solid fuel from the transfer chamber 28. The displacement member has, as shown in the plan view of FIG. 3 and the sectional view of FIG. 5, an inclined side 82 adjacent the pivot axis, and a side rounded in a convex form in the horizontal plane 84 remote from the pivot axis. As shown in FIG. 6, the top 86 and bottom 88 of the displacement member 80 are generally planar. A front surface 90 is inclined at a small angle to the vertical.

The bottom plate projects out beyond the front surface of plate 90 by an amount which is nil at the side adjacent the hinge, but which increases progressively towards the side adjacent the handle. A tapered insert 92 is then attached, as by welding, to the bottom and front plates 88, 90, as shown in FIG. 6.

All the various elements of the displacement member may be formed from sheet steel and are welded together. To ensure that the displacement member has sufficient strength to displace logs etc. from the chamber and sufficient strength to withstand pressure from being forced against a full log magazine without collapsing or becoming damaged, various stiffening elements are provided within it. Thus, a rear plate 93 extends across the back of the displacement member. Reinforcing plates 94 are welded to this, as shown in FIG. 5. A reinforcing rod 96 is provided at the junction between the hinge side 82 and the front surface 90. A perpendicular reinforcing plate 98 and an inclined plate 100 extend from the reinforcing rod 96 to the reinforcing plates 94. A series of first stiffening plates 102 are provided extending between the inclined plate 100 and the front surface or sheet 90. Similarly, second stiffening plates 104, which are parallel to the plane of the door 50 extend between one of the stiffening plates 102 and the rounded side 84. The interior of the door 50 and member 80 are filled with insulation, as indicated at 106.

Figure 3:
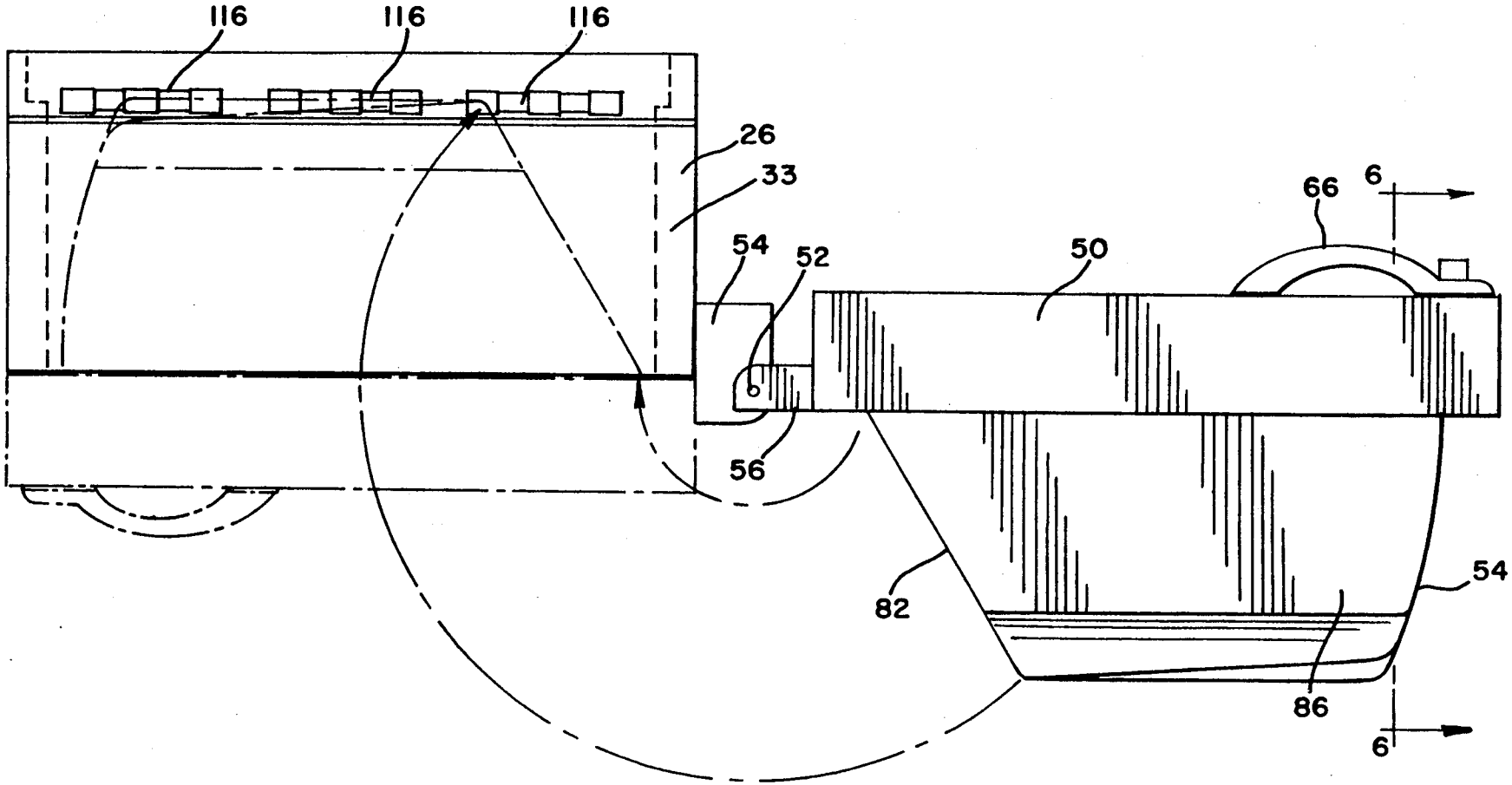
FIG. 3 is a plan view of the door mechanism of FIG. 1.

At the inner side of the body 26 there is an inner door 110. The door is pivoted about a horizontal pivot axis 112. The axis may not prove to be optimal; in use, the upper edge adjacent a seal 121 first moves downwards, rather than rearwards. It may prove preferable to move the axis to the right, as viewed in FIG. 4. The axis is formed by a series of three hinges 114, as shown in FIG. 3. One side of each hinge is secured to the top wall 30, while the other side is secured to the inner door. The door includes inner and outer plates 115 and, 116. These are welded together as before, and, if necessary can be provided with various stiffening ribs etc. The lower end of the inner door 110 is provided with a solid stainless steel edge member 118. The interior of the door 110 is filled with insulation 120.

While it is intended that the principal seal will be provided at the outer door 50, a seal is provided for the inner door 110. The inner seal is a resilient gasket 121, which extends in a channel in the top wall 30 and the two side walls on either side.

The bottom wall 32 of the transfer chamber has a corresponding solid stainless steel edge member 122, welded to the two plates thereof. A channel is provided in this edge member 122 and a resilient gasket strip 124 inserted in it.

As described below, in use, it is anticipated that wood and other solid fuel will pass between the door 110 and the bottom wall 32 with a rubbing action. For this reason, the edge members 118, 122 are provided with a relatively large cross section and are tapered to abut one another as shown. The edge members 118, 122 should thus be capable of absorbing a considerable amount of abrasion and wear, before any maintenance is required.

As will become apparent below, despite the presence of the outer and inner doors 50, 110, there is still the possibility that fumes could escape through the transfer chamber 28. To overcome this, a purge device is provided, as shown in FIGS. 7 and 8.

Figure 7:
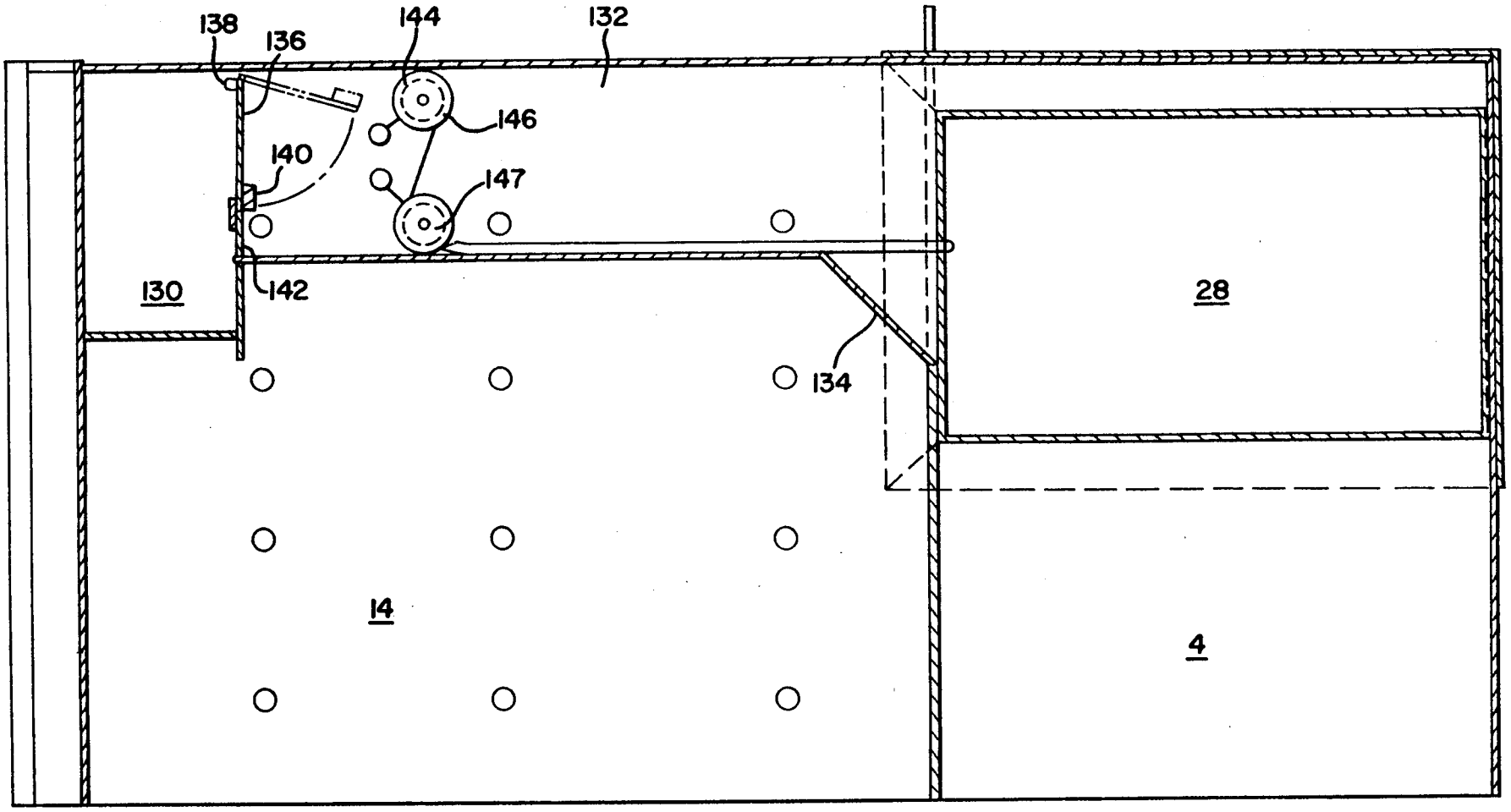
FIG. 7 is a vertical section showing part of the door mechanism and a fume purge device along lines 7—7 in FIG. 1.

Referring to FIG. 7, on the right hand side, there is shown the log magazine or store 4, and to the top and to the right of it the transfer chamber 28. To the left of the store is the heat exchanger 14. At the left hand side of the heat exchanger there is a flue (not shown) for exhaust gases from the furnace. The flue connects to a cross duct 130 extending all the way across the heat exchanger 14. On either side of the heat exchanger 14, there is a purge duct. One purge duct 132 is shown in FIG. 7. The other purge duct 132 is generally symmetrical on the other side of the heat exchanger 14. The purge duct 132 is of generally rectangular section and extends towards the transfer chamber 28 and inner door 110. The end of the duct 132 adjacent the door 110 is enlarged, as shown at 134. A purge door 136 is pivotally mounted about an upper horizontal axis 138. The door 136 includes a weight 140 for returning it to the vertical position as shown. A lower sill 142 is provided against which the door 136 can abut. The purge door on the other side is provided with a common pivot shaft, so that the two purge doors function simultaneously.

To open the door 136, an actuation cable 144 is provided. Upper and lower pulleys 146, 147 are mounted to a side wall of the purge duct 132 and the cable 144 extends around these as shown.

Figure 8:
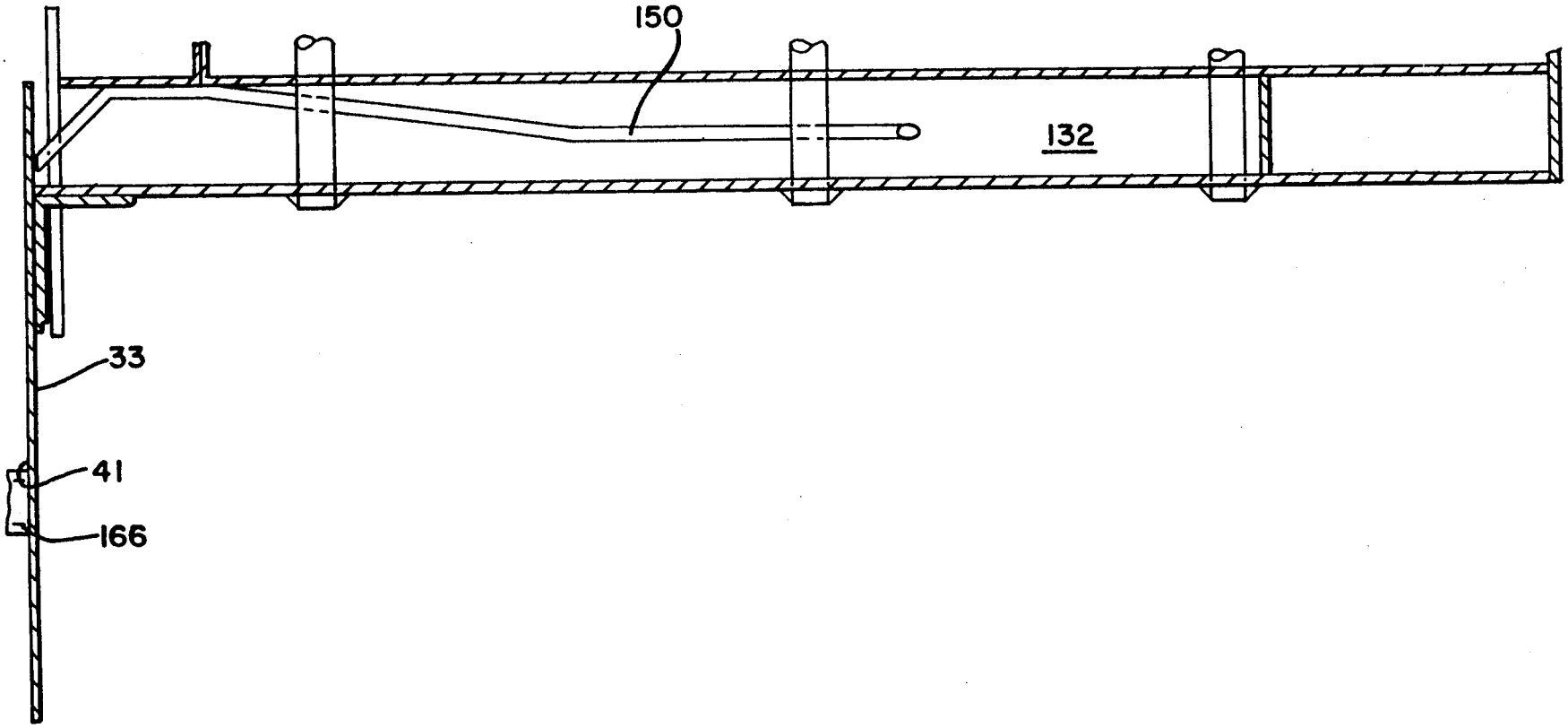
FIG. 8 is a horizontal section showing part of the purge mechanism along lines 8—8 in FIG. 1.

Referring to FIG. 8, a guide tube 150 guides the cable for the remainder of its run. Thus, the guide tube 150 extends along the purge duct 132 and through a series of bends and then into side wall 33 of the transfer chamber 28. Here, the tube 150 is welded to the respective bridging pieces 40, 41. The cable 144 emerges from the tube 150 and is attached to the outer door 50.

In use, the door mechanism 20 is operated as follows. The outer door 50 is opened by means of the handle 66, to withdraw the displacement member 80 from the transfer chamber 28.

Logs or other solid fuel can then be inserted into the transfer chamber 28. It is to be noted that the chamber 28 is at a convenient height. Further, the outer door 50 can simply be left opened, so that both hands can be used to grasp a log and insert it horizontally into the chamber 28. With the chamber 28 full with the desired number of logs, the outer door 50 can be closed.

When the outer door 50 is opened, the cable 144 is pulled through the tube 150 and around the pulleys 146, 147 to open the purge door 136 to the position shown as a ghost outline in FIG. 7, as well as the purge door on the other side. Consequently, during the time that the outer door is open, gases, fumes etc. are withdrawn from the top of the log store or magazine. The flow is sufficient to maintain a slight negative pressure adjacent the door mechanism 20. Hence, any leakage through the door mechanism will be ambient air flowing into the fuel magazine. In some circumstances a draft inducer may be used to provide the slight negative pressure.

The outer door 50 is then closed by simply swinging it to the closed position as indicated in FIG. 3. FIG. 5 shows the progressive movement of the displacement member from the open to the closed position. As the displacement member enters the transfer chamber 28, the inclined hinge side 82 and its junction with the front surface 90 contacts the logs first. Further motion of the member 80 will push the logs towards the rear of the transfer chamber 28. The logs in turn will abut the inner door 110 and start to open it; the open position of the door 110 is shown in ghost outline in FIG. 4, and a log is shown in ghost outline at 150 opening the inner door 110, immediately prior to falling under the influence of gravity into the fuel store.

Thus, there is an intermediate position, in which the inner and outer doors 50, 110 are both to a certain extent open. However, the escape of fumes etc. is prevented by the purge system drawing fumes etc. through the purge ducts 132. Further, while this motion is described in some detail for clarity of explanation, it will be appreciated that in practice, the outer door 50 can be closed in one swift action, so that the simultaneous opening of the inner and outer doors 50, 110 will only be momentary.

As the outer door 50 is closed further, the inclined side 82 rotates around, to bring the front surface 90 up against the logs. Ultimately, as the door 50 approaches the closed configuration, the front surface 90 will be approximately parallel to the logs. This is shown as a ghost outline in FIG. 3.

The inclination given to front surface 90 and the tapered insert 92 are intended to ensure that logs exit the chamber 28 and do not in any way become jammed or jam the inner door 110 open. Thus, when the displacement member 80 reaches the closed position of FIG. 4, any logs etc. will naturally roll down the front face 90 and into the stored 4. The horizontal movement of the logs causes inner door 110 to be opened. The logs will initially hold the door 110 open to the extent necessary, following which, inner door 110 will release the moving logs into the fuel store. As the logs leave the transfer chamber 28, they will rub against the edge members 118, 122.

When all the logs have left the transfer chamber 28, the door 110 will swing down to the closed position shown in FIG. 4, ready for the next loading operation.

When the furnace is in operation, combustion is maintained in the combustion chamber 2, with combustion air being supplied and exhaust gases drawn off. Fumes etc. may rise into the log store 4. However, this is entirely closed, and fresh air is prevented from entering it, so that combustion cannot develop in this area.

The door mechanism 20 enables the store 4 to be quickly and simply recharged, even when the furnace 1 is hot. Thus, if at any time one wishes to leave the furnace unattended for a significant period, the door mechanism 20 can be used to fully load the log store 4. This would likely require a number of successive operations of the door mechanism 20. The furnace 1 can then be left unattended, and the roller mechanism 6 will be actuated to ensure that fuel is supplied at the required rate to the combustion zone 2.

The log store 4 can be so dimensioned as to keep the furnace 1 running for any desired length of time. Typically, it would be dimensioned to enable the furnace 1 to run at least overnight, so that a fire can be maintained continuously for that period. Preferably, it would hold sufficient fuel for 24 hours of operation, so that it would only need to be recharged once a day.

While the invention has been described primarily in relation to a wood-burning furnace, it will be appreciated that the roller mechanism 6 and mechanism 20 are suited to many types of solid fuels and the mechanism can be applied to a variety of appliances. Thus, coal, coke, peat or other solid fuels could be charged in this manner. Also, the mechanism could by used for charging a variety of solid material into a magazine or other receptacle, where it is desirable to minimize gas or vapour transfer into or out of the magazine or receptacle.

In addition to a purge system an interlock feature can be provided, which feature shuts off the combustion air supply to the furnace when the outer door is to be opened. In this way combustion in the furnace is reduced during the time period that the outer door is open and therefore the escape of combustion fumes can be further minimized.

What is claimed is:

1. A door mechanism for supplying solid fuel to a store of a furnace, the mechanism comprising:

(a) a body defining a transfer chamber and having an inlet and an outlet;

(b) an inner door movably connected to the body for closing the outlet, the inner door normally closing off the outlet but being displaceable by the fuel to an open position;

(c) an outer door connected to the body and movable between a closed position closing off the inlet and an open position; and (d) a displacement member connected to the outer door for displacing solid fuel from the transfer chamber through the outlet, the displacement member occupying substantially all of the transfer chamber when the outer door is in the closed position.

2. A door mechanism as claimed in claim 1, wherein the body has top, bottom and sidewalls, with the width between these side walls being substantially greater than the height between the top and bottom walls.

3. A door mechanism as claimed in claim 2, wherein the outer door is pivotally mounted to the body about a vertical axis adjacent one side wall of the body.

4. A door mechanism as claimed in claim 3, wherein a side of the displacement member remote from the pivot axis of the outer door has a convex shape in the horizontal plane.

5. A door mechanism as claimed in claim 4, wherein the exposed angle defined by the side of the displacement member adjacent the pivot axis of the outer door and the inner surface of the outer door is greater than ninety degrees.

6. A door mechanism as claimed in claim 5, wherein the interior angle defined by the top surface of the displacement member and the front surface of the displacement member is greater than ninety degrees.

7. A door mechanism as claimed in claim 6, wherein the front surface of the displacement member includes a tapered insert along a lower edge thereof.

8. A door mechanism as claimed in claim 6, wherein the bottom of the transfer chamber is generally horizontal.

9. A door mechanism as claimed in claims 1, 2 or 3, wherein the inner door is pivotally mounted about a horizontal axis above the outlet.

10. A door mechanism as claimed in claim 2, wherein the interior angle defined by the top surface of the displacement member and the front surface of the displacement member is greater than ninety degrees and the inner door is pivotally mounted about a horizontal axis adjacent above the outlet.

11. A door mechanism as claimed in claim 6, wherein each of the body and the inner and outer doors and the displacement member has a hollow construction, which is filled with insulation.

12. A door mechanism as claimed in claim 11, wherein the outer door comprises separable inner and outer shells.

13. A door mechanism as claimed in claim 11, further comprising a sealing gasket between the outer door and the body.

14. A door mechanism as claimed in claim 13, wherein one of either the outer door or the body contains a pair of slots, which are concentric with one another and in each of which the resilient gasket is mounted, and the other of either the outer door or the body has a corresponding pair of projections, concentric with one another for engaging the gaskets to form a seal when the outer door is in the closed position.

15. A door mechanism as claimed in claim 13, wherein an inner door seal is provided for the inner door.

16. A door mechanism as claimed in claim 8, 10 or 13, wherein an edge of the inner door remote from the pivot axis thereof and a corresponding edge of the body are provided with reinforced edge members having mating surfaces.

17. A door mechanism as claimed in claim 6, in which the displacement member is reinforced.

18. A door mechanism as claimed in claim 17, wherein the displacement member includes a reinforcing rod at a junction between the side of the displacement member adjacent the pivot axis and the inclined front surface, and a perpendicular reinforcing plate extending from the rod perpendicularly to the plane of the outer door and an inclined reinforcing plate extending from the rod at an angle to the plane of the door and away from the pivot axis thereof.

19. A door mechanism as claimed in claim 18, wherein the displacement member includes a plurality of stiffening plates in the interior thereof.

20. A door mechanism as claimed in claim 17, wherein each of the inner and outer doors, the body and the displacement member is of hollow construction and is filled with insulation.

21. A door mechanism as claimed in claim 18 or 20, wherein a seal is provided for each of the inner and outer doors, and an edge of the inner door remote from the pivot axis thereof and a corresponding edge of the body are provided with strengthened edge members.

22. A door mechanism as claimed in claim 1, 6 or 10, in combination with a solid fuel burning appliance further comprising:

(a) a housing;
(b) a combustion chamber defined within the housing;
(c) a fuel store above the combustion chamber;
(d) a mechanism for feeding fuel from the fuel store to the combustion chamber; wherein the door mechanism is mounted for supplying fuel to the fuel store, the fuel store being otherwise closed; and
(e) a purge device to prevent combustion fumes from escaping through the transfer chamber.

23. A door mechanism for supplying solid fuel to a store of a furnace, the mechanism comprising:

(a) a body defining a transfer chamber, wherein the body has top, bottom and side walls, with the width between the side walls being substantially greater than the height between the top and bottom walls and wherein the bottom of the transfer chamber is generally horizontal and further wherein the transfer chamber has an inlet and an outlet and also further wherein the body has a hollow construction which is filled with insulation;
(b) inner door pivotally mounted about a horizontal axis adjacent above the outlet wherein the inner door has a hollow construction which is filled with insulation and wherein an inner door seal is provided for the inner door and further wherein an edge of the inner door remote from the pivot axis is provided with a strengthened edge member, the inner door normally closing off the outlet but being displaceable by the fuel to the open position;
(c) an outer door pivotally mounted to the body about a vertical axis adjacent one side wall of the body wherein the outer door has a hollow construction which is filled with insulation and further wherein the outer door comprises separable inner and outer shells and further wherein one of either the outer door or the body contains a pair of slots which are concentric with one another and the other of either the outer door or the body has a corresponding pair or projections also concentric with one another, movable between a closed position closing off the inlet and an open position;
(d) two sealing gaskets mounted in each of the slots contained in either the outer door or the body in such a way that the corresponding pair of projections in the other of either the outer door or the body engages the gaskets to form a seal when the outer door is in the closed position; and
(e) a displacement member mounted to the outer door for displacing solid fuel from the transfer chamber through the outlet wherein the displacement member occupies substantially all of the transfer chamber when the outer door is in the closed position and also wherein the side of the displacement member remote from the pivot axis of the outer door has a convex shape in the horizontal plane and further wherein the exterior angle defined by the side of the displacement member adjacent the pivot axis of the outer door and the inner surface of the outer door is greater than 90 degrees and also further wherein the interior angle defined by the top surface of the displacement member and the front surface of the displacement member is greater than 90 degrees and wherein the displacement member includes a reinforcing rod at a junction between the side of the displacement member adjacent the pivot axis and the inclined front surface, and a perpendicular reinforcing plate extending from the rod perpendicularly to the plane of the outer door and an inclined reinforcing plate extending from the rod at an angle to the plane of the door and away from the pivot axis thereof and also wherein the displacement member includes a plurality of stiffening plates in the interior thereof.

* * * * *

UNITED STATES PATENT AND TRADEMARK OFFICE

CERTIFICATE OF CORRECTION

PATENT NO. : 5,099,769

DATED : March 31, 1992

INVENTOR(S) : A. STEPHEN PETRIE et al.

It is certified that error appears in the above-identified patent and that said Letters Patent is hereby corrected as shown below:

Column 1, line 19, delete "eg." and substitute --e.g.--.

Column 1, line 60, delete "provided" and substitute --provide--.

Column 4, line 51, delete "member" and substitute --members--.

Signed and Sealed this

Sixteenth Day of August, 1994

*Attest:*

Bruce Lehman

BRUCE LEHMAN

*Attesting Officer*

*Commissioner of Patents and Trademarks*